US005129568A

United States Patent [19]

Fokos et al.

[11] Patent Number: 5,129,568

[45] Date of Patent: Jul. 14, 1992

[54] OFF-LINE WEB FINISHING SYSTEM

[75] Inventors: Robert Fokos, Wayland; Robert M. Williams, Norton; Orfeo J. Salvucci, Holbrook, all of Mass.

[73] Assignee: Sequa Corporation, New York, N.Y.

[21] Appl. No.: 467,941

[22] Filed: Jan. 22, 1990

[51] Int. Cl.[5] ..... B41F 13/02

[52] U.S. Cl. ..... 226/27; 101/248; 226/40

[58] Field of Search ..... 226/24, 27, 32, 33, 226/34, 35, 36, 40; 101/181, 248

[56] References Cited

U.S. PATENT DOCUMENTS

| | | | |
|---|---|---|---|
| 2,326.931 | 8/1943 | Dalton et al. | 226/32 X |
| 3,556,509 | 1/1971 | Crum | 226/28 X |
| 3,841,216 | 10/1974 | Huffman | 101/181 |
| 4,078,490 | 3/1978 | Biggar, III | 101/248 |
| 4,085,674 | 4/1978 | Biggar, III | 101/248 |
| 4,096,801 | 6/1978 | Martin | 101/181 X |
| 4,452,140 | 6/1984 | Isherwood et al. | 101/181 |
| 4,473,009 | 9/1984 | Morgan | 226/40 X |
| 4,694,749 | 9/1987 | Takeuchi et al. | 101/426 |
| 4,824,503 | 4/1989 | Wilen | 156/204 |

*Primary Examiner*—Daniel P. Stodola

*Assistant Examiner*—P. Bowen

*Attorney, Agent, or Firm*—Mitchell D. Bittman; Peter J. Manus

[57] ABSTRACT

An off-line web finishing system performs plural functions on a pre-printed and rewound web at a series of pieces of equipment arranged in a line. Tension in the web is set at a variable infeed at a constant value that is sufficient to facilitate handling of the web. A common web-transport system drives all draw rolls in the line in unison, at the same speed, and without slippage between the web and the rolls. In the preferred form, a second drive line rotates in unison the function cylinders of pieces of equipment that are registration sensitive. The second line is driven by a main line shaft of the web transport system via a variable transmission that is adjusted in response to at least one optical scanner that senses misregistrations between the printed pattern on the web and the function cylinders. The registration sensitive function cylinders operate on the web only intermittently. Each function cylinder preferably has an associated scanner that operates a variable transmission between the second line and the associated function cylinder to further control the registration of the equipment to the web.

13 Claims, 4 Drawing Sheets

OFF-LINE WEB FINISHING SYSTEM

BACKGROUND OF THE INVENTION

This invention relates in general to printing. More specifically, it relates to web finishing, and in particular to off-line web finishing of pre printed and rewound webs.

In the manufacture of magazines, mailing inserts, envelopes, brochures and many other printed products, the product is printed on a web of paper, traveling through a printing press at high speed, up to 2,000 feet per minute. In most printing applications, and certainly those where there is color printing or where the web is run through the press more than once, it is essential to maintain a very precise registration between the web and the printing cylinders acting on the web. This is difficult since paper is elastic and in most modern printing presses such as commercial web offset presses the paper is moistened by ink and water and then heated in dryer. This wetting and drying causes unpredictable variations in the properties of the paper, including its length, which creates a problem in maintaining registration between the web and the equipment acting on it.

In printing presses, the standard approach to maintaining registration has been to stretch the web until it is back in registration, or to hold it in registration against a shrinkage associated with drying. The former technique is the most common approach. For example, in the printing of newspapers with color. The color is first printed on the web, but printed "short", that is, the length of the impression or pattern printed on the web by one revolution of a print cylinder is slightly less than the desired final length. In a second pass, when black ink only is printed on the web, the web is stretched between a pair of draw rolls to the desired full impression length. The web has registration marks printed on it at regular intervals. Optical scanners detect the marks, compare the sensed impression length with the desired value, and produce an electrical control signal. The value and sign of the signal is used to increase or decrease the speed of the downstream roll, and thereby adjust the length of the web. This mode of adjustment, which is perhaps the most widely used, requires a slippage between the draw roll, e.g. a chill roll following the dryer, and the web, but there can be no slippage between the print cylinders and the web. In other systems the adjustment is made by changing the path length of the web between sets of draw rolls, as with a dancer roll that moves under control of the registration correction signal.

In U.S. Pat. No. 4,096,801 to Martin the web in a printing press is secured against slippage with respect to all of the rolls. The dryer in the press is assumed to produce a shrinkage of the web. By drawing the web at a uniform speed throughout the press, the web is automatically stretched back to its initial length. In other words, Martin "locks" the printing and draw roll cylinders onto the web and thereby secures the web in a known relationship (registration) with respect to the cylinders operating on it.

Registration is also a very significant problem in web finishing, as opposed to web printing. Web finishing is the processing of a printed web to a finished product such as a multi-page "signature" which forms a magazine, or a part of a magazine. The processing often includes folding, perforating, spot application of glue, die cutting and rotary cutting. These functions are usually performed by a series of machines arranged in a line. These operations can be performed "in-line", that is, receiving a freshly printed web directly from a printing press, or "off-line", that is, receiving the web from a rewound, pre printed roll. In recent years finishing has been principally in line. A principal reason for this is that if the printed web is wound and stored, because the paper is elastic, responsive to environmental conditions such as humidity and temperature, and has been strained by processing, its properties change over time. For finishing, a crucial problem is that once stored the dimensions of the paper change unpredictably and nonuniformly, which of course changes the repeat length of the pattern along the web. The pattern may shrink, expand, or do both within the same rewound web. In-line finishing avoids the problems by not allowing time for the web to change.

In line finishing has also found favor because prior off-line finishing set preconditions on how the web is printed in order to allow finishing of a rewound roll. A typical precondition is requiring that the web be printed "short" so that it can be stretched back into registration in the finishing line. Ideally, the printing process should be completely independent of the finishing process; any roll from any printing press should be able to be finished along with other rolls from other presses of the same repeat length. This objective is not attainable with current off-line systems.

In line web finishing, however, has several significant disadvantages. First, it is too slow to be operationally linked to modern printing presses without significant costs. A typical operational speed of a press is up to 2,000 feet per minute, whereas an in line finishing system typically operates at up to 1,000 feet per minute. The in-line web finishing therefore cuts the productivity of the entire printing press about in half. Second, in in-line finishing system has a significant make ready time, typically 8 to 48 hours, as a series of pieces of equipment are adjusted to very tight tolerances. While the finishing equipment is made ready, the printing press, which is a substantial capital investment, is idle. This further reduces the productivity of the entire printing operation. In the known newspaper printing system where black ink is applied in a second pass there is only one operation, the printing of black ink; a finishing line will normally perform 20 to 30 operations on the web in one pass.

Several other design problems have plagued automated finishing operations. One is that the tension used to stretch the web to maintain registration can be sufficient to weaken or even break the web, particularly lightweight webs such as those used to form airmail envelopes. Web breaks are costly since some printed material is wasted and because the line is down while the web is refed through the line and registration adjusted. Another problem is maintaining registration despite 1) rapid, often local, changes in the repeat length—which requires a fast dynamic response—and 2) accumulating registration errors of the same type long or short repeat lengths) that cannot be accommodated by registration adjustment mechanisms in the system.

As noted above, in general the prior art solution to the registration problem has been to stretch the web, and therefore increase the tension in the web, until it is in registration. The most widely used arrangement is to have a variable speed draw roll operating under the control of an optical scanner that looks at the registration marks. This system works, but it does not work for light weight paper, it does not have a fast dynamic response time and while it may be acceptable for simple printing and finishing operations, e.g. where the only operation is to print black ink, it is not well suited for use in a high speed finishing line which performs, on average 20 to 30 operations.

With regard to the response time, conventional scanning equipment monitors the web once during the passage of multiple impressions, usually in the range of 10 to 100 depending on factors such as the press or line speed, the size of the impressions, and the capabilities of the monitoring equipment, and the susceptibility of the registration control system to "hunting". In web finishing, there can be significant variations in the registration between these monitorings and there can be cumulative errors which can accumulate to a significant registration error before the situation is monitored, let alone corrected. Moreover, even if one monitors more often, not all control system and adjustment equipment can respond to the rapid variations quickly enough. The result can be that the adjustment system hunts but cannot keep up with the corrections required. Also, where the errors are cumulative, the system may not be able to keep up with the ever growing misregistration. With respect to the number of operations performed in a finishing line, the problem is that if the tension in the web is adjusted at one station to produce a correct registration, this change in tension will fight against the registration of the web at other stations where other operations are performed. In short, tension adjustments at one location fight adjustments at another location leading to increased difficulties in maintaining registration throughout the finishing line, and to an increased likelihood that the tension will reach a level sufficient to break the web.

As noted above, in some systems registration is maintained by adjusting the paper path length as it traverses the printing press or finishing line. A common technique is to pass the web over a movable, pre loaded idler or "dancer" roll so that changes in registration can be affected by changes in the speed at which the paper is moving with respect to the equipment at different points, which results in changes in the total length of the paper in the press or line. Path length adjustments work for certain applications, but they cannot deal with the accumulating adjustments required for off-line web finishing. For example, if a web should have a repeat (impression) length of 630.0 mm, but is consistently printed long at 630.25 mm, during the passage of 100 impressions, in a few seconds, there is a cumulative misregistration of 25 mm, about one inch. While a path length change can in theory compensate for this cumulative error, it cannot do so indefinitely. In the case of the dancer roll, its travel will eventually reach an extreme limit position and it will be unable to make further compensating movements.

U.S. Pat. Nos. 4,078,490 and 4,085,674 to Biggar compensate for misregistration by changing the phase angle between an output gear (acting through a worm gear) and a line shaft. Registration units operate at each station. In the '674 patent, for example, a registration unit for a die cutting station has a motor that rotates a sleeve relative to a shaft of a first cylinder. This rotation shifts the phase of a drive gear and a die cylinder relative to the first cylinder. There is no apparent control of web tension to hold it at a constant value. There is likewise no way to deal with cumulative errors other than through constant adjustment of the phase angle. While this is theoretically a solution, in practice known systems cannot keep up with the accumulation errors that may be encountered in processing rewound webs.

U.S. Pat. No. 4,452,140 to Isherwood et al. describes another system, one using a dancer roll to adjust paper path length, as discussed above. In FIG. 2 Isherwood et al. show a further registration adjustment at a downstream processing station. This further registration can be accomplished by a differential gear assembly to introduce phase angle adjustments. The web is monitored by a single detector. There is no teaching to maintain the tension in the web constant.

U.S. Pat. No. 3,841,216 to Huffmann discloses a system for registration control on a second pass of a printed web, with registration marks, through a printing press or "processing device". Huffmann adjusts first by metering the web at the infeed rolls. Other variations, termed by Huffmann as a "stretch factor", are compensated by a proportional registration shaft Z driven by a differential 106 responsive to sensed registration errors. The signals control signals reflect inputs from an electric eye and an encoder. Rotation of the shaft Z alters the web path length (FIG. 4) and the phase relation of the blanket cylinders of printing stations in the press. The Huffmann system also adjusts the feed rate of the web to control registration. These adjustments change in tension in the web. Huffmann provides a hybrid system which controls registration using both adjustments in web ten ion and in paper path length. However, it is limited in its ability to compensate for cumulative errors to the same extent as the Isherwood path length adjustment system. Also, it is in essence a more sophisticated variation on the standard "stretch into register" approach. The web is pulled to achieve registration.

None of these known systems, whether those described above generally or the specific arrangements disclosed in the patents identified above, have resulted in commercially acceptable off-line web finishing systems. No known system, to the best of applicants' knowledge is capable of finishing very lightweight webs, nor is any known system capable of dealing with the rapidly changing variations in the position of the repeat pattern on the web and with the problem of cumulative errors of the same type. To date, no known system provides reliable, high quality finishing of previously printed webs, particularly while handling the web sufficiently gently that even lightweight webs can be processed.

It is therefore a principal object of the present invention to provide a registration control arrangement for finishing printed webs which operates on lightweight webs and maintains excellent registration at high speeds despite the presence of both localized and cumulative errors in the position of the impressions.

Another principal object is to provide a registration control system that can operate off-line on pre-printed, re-wound webs.

Still another object is to provide a registration control system for off-line finishing of a rewound, preprinted web that imposes no preconditions on the printing for a given repeat length, and therefore can finish any roll printed on any press having the same repeat length.

A further object is to provide a web finishing system that can operate even o very lightweight webs such as tissue used to form airmail envelopes.

Another object is to provide a web finishing system with the foregoing advantages that can operate at high speeds such as the operating speeds of modern printing presses.

Still another object is to provide a system with the foregoing advantages which is characterized by a reduced make ready time and which can be operated independent of a printing press so that the press is productive even during make ready.

Another object is to provide a system with the foregoing advantages which has a favorable cost of manufacture, utilizes many standard components such as known in line web finishing equipment.

SUMMARY OF THE INVENTION

A web finishing system has a series of pieces of equipment arranged in a line to perform multiple functions on a printed web traveling through the line at a high speed, preferably about 1,000 feet per minute, but as high as 2,000 fpm. At least certain pieces of the equipment, such as perforators, pattern gluers, die cutters and rotary cutters, are registration sensitive. This equipment has at least one function cylinder that acts intermittently on the web in precise coordination with a series of impressions printed on the web. Each impression extends longitudinally along the web for a repeat length. The web also has registration marks printed on it.

A registration control system includes: 1) a web transport system that drives all of the draw rolls in the line at the same speed from a common line shaft; 2) a second line shaft driven by the main line shaft via a variable transmission operated in response to control signals that reflect a comparison between the angular position of the function cylinder of the finishing equipment and the registration mark; and 3) a variable infeed that sets the tension in the web at a value to facilitate handling. There is no slippage between the web and the draw rolls and there is no overdrive tending to stretch the web; the tension set at the infeed remains constant throughout the line. Because the function cylinders engage the web only intermittently, their surface speed can vary from that of the web. The second line shaft drives all of the function cylinders in unison so that an adjustment to correct a cumulative error is made simultaneously at all of the function cylinders. Preferably each function cylinder also has an optical scanner associated with it that is used to produce a control signal for a variable transmission between the second line and the associated function cylinder to fine tune the registration adjustment.

The web transport system includes all of the draw rolls, typically including those at the infeed, chill roll, outfeed, plow tower and a rotary cutter at the end of the line. There is no slippage between the web and these draw rolls. The web infeed preferably sets the tension at as low a value as is necessary to handle the web. For light stock, a constant tension of 2–5 pounds per linear inch is preferred. The tension is set between the infeed and the draw roll of the final station. Both the web transport and the second, phase adjustment line, are preferably driven by a common D.C. motor. The second line follows, that is, is driven by, the main line shaft via a variable differential that can vary their relative angular positions.

These and other features and objects of the present invention will be more fully understood from the following detailed description which should be read in light of the accompanying drawings.

DETAILED DESCRIPTION OF THE PREFERRED EMBODIMENTS

Figure 1:
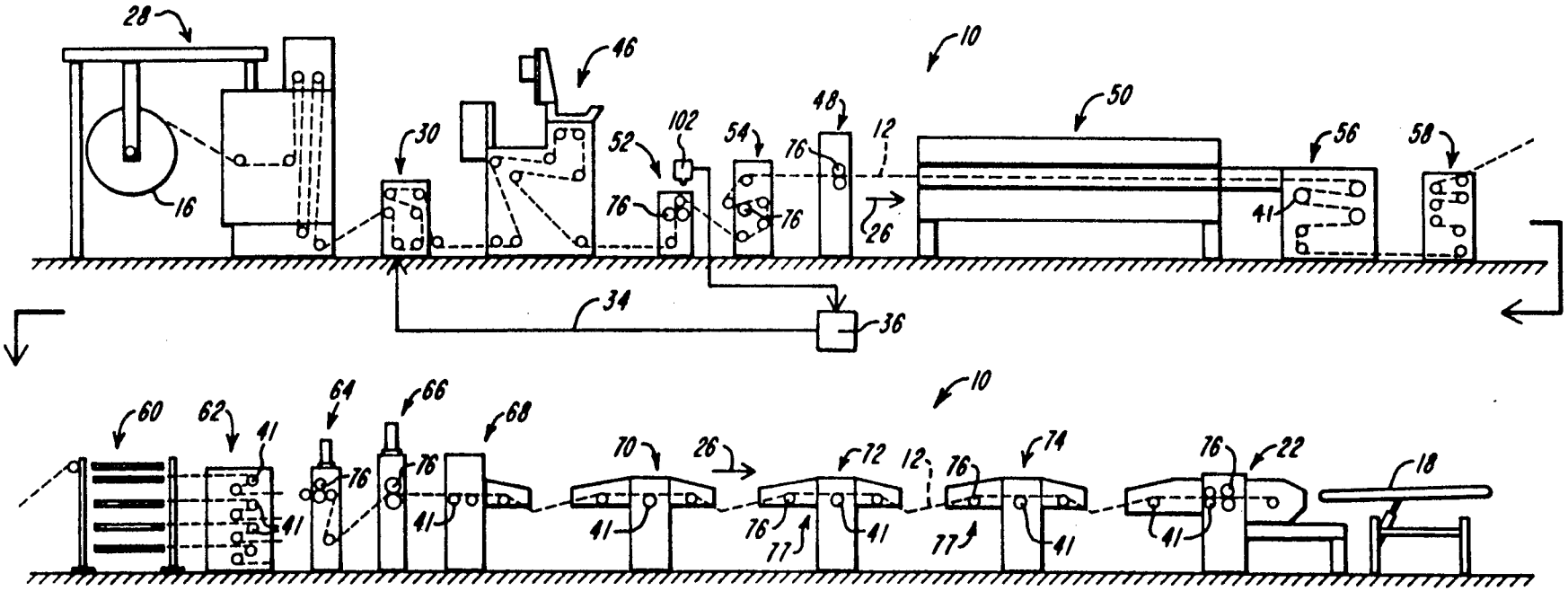
FIG. 1 is a view in side elevation of an off-line web finishing system according to the present invention.
Figure 2:
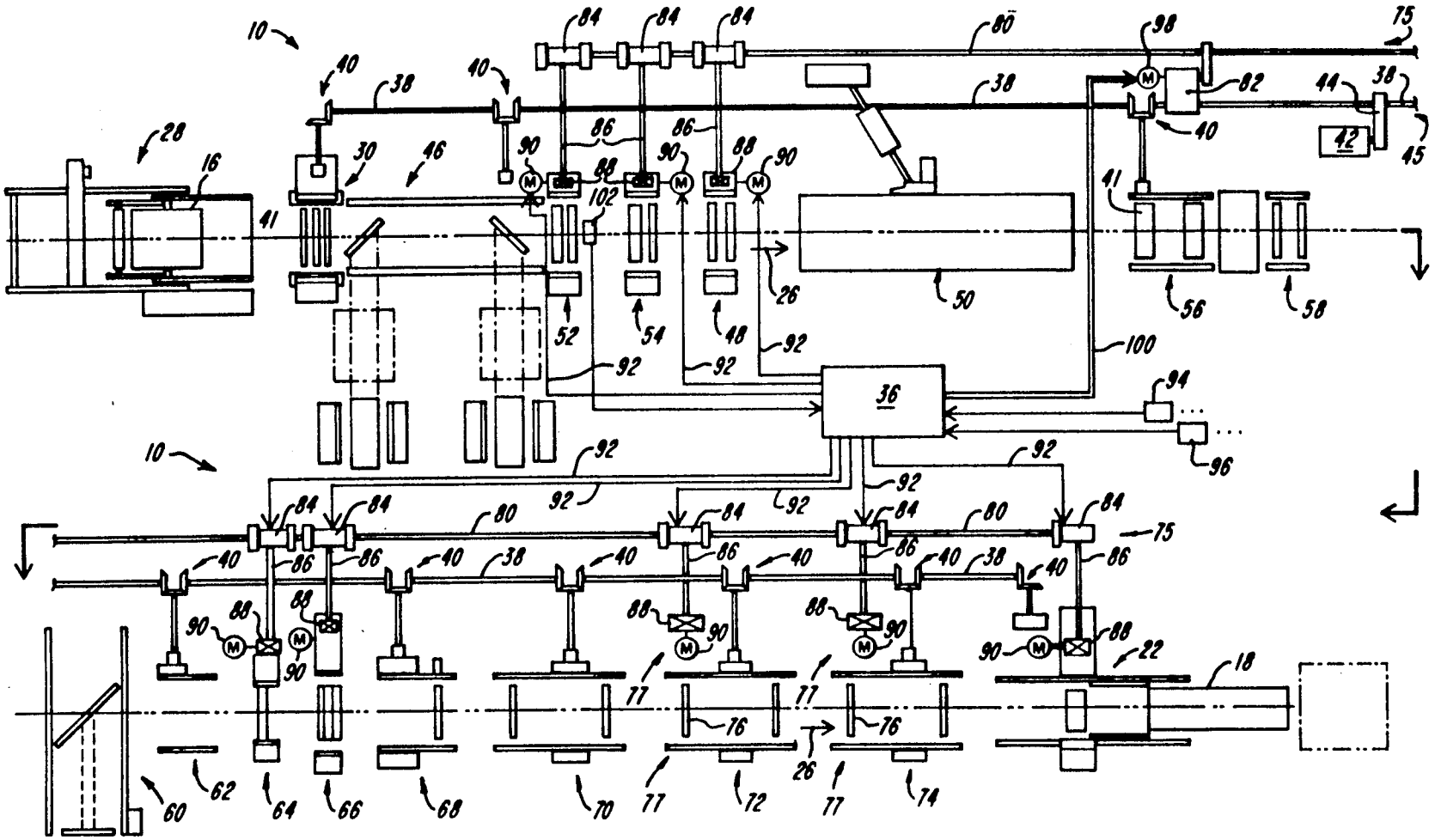
FIG. 2 is a top plan view corresponding to FIG. 1.
Figure 3:
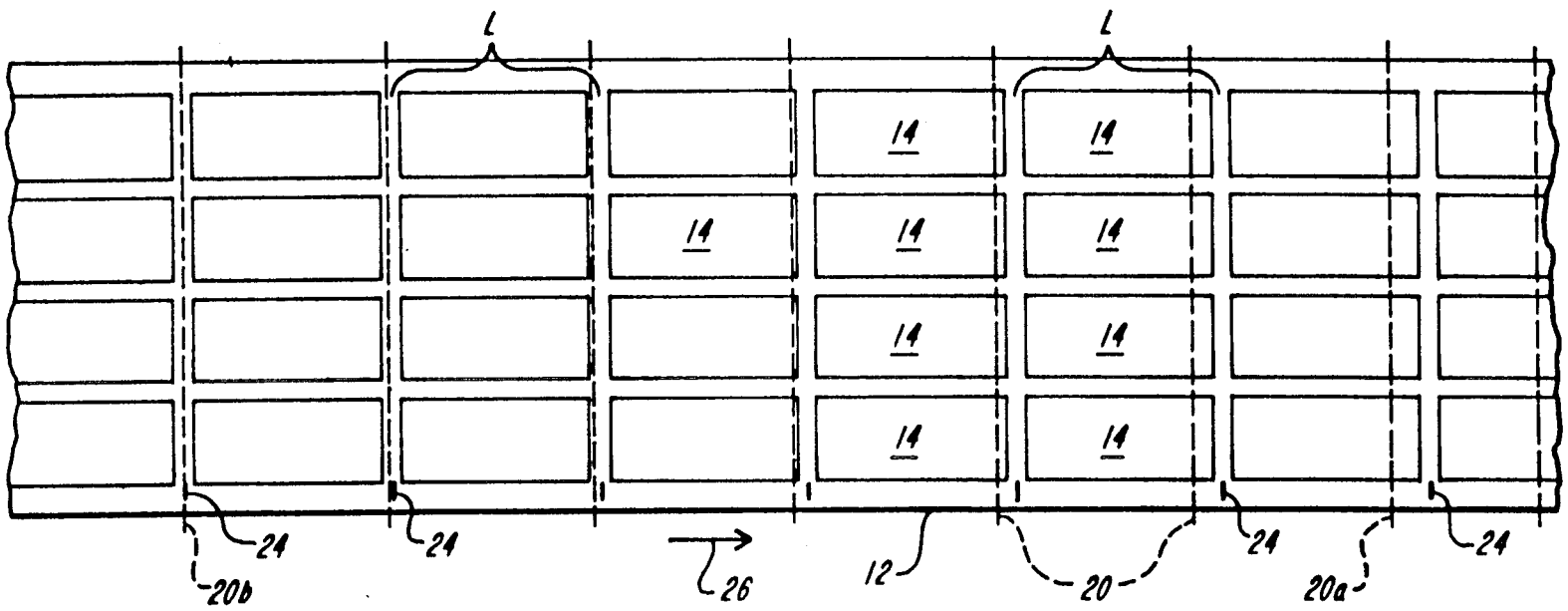
FIG. 3 is a top plan view of the web shown in FIGS. 1 and 2 having a succession of impressions printed long with an accumulating misregistration error.
Figure 5:
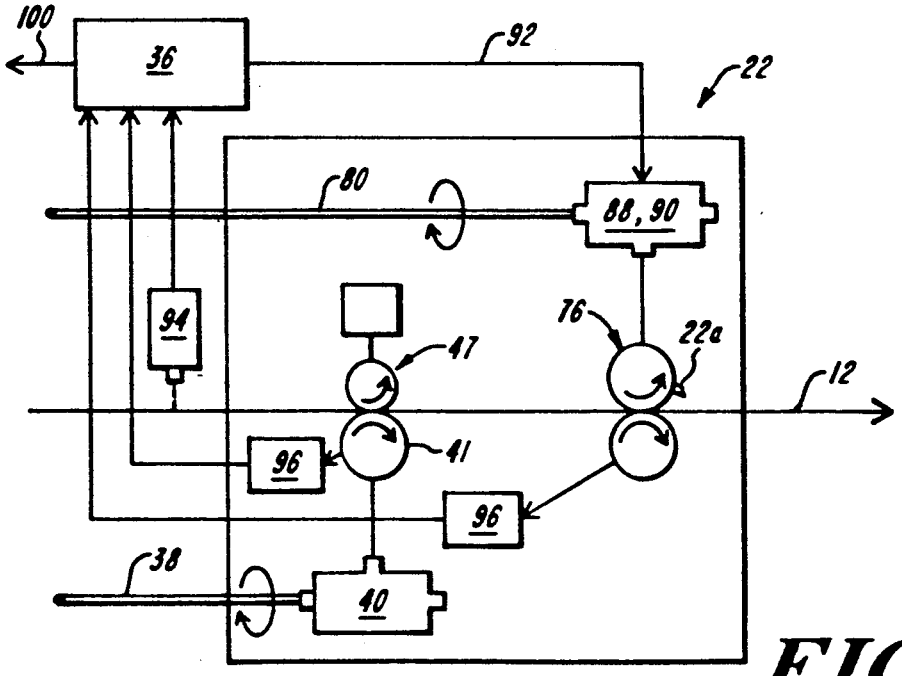
FIG. 5 is a highly simplified schematic view in side elevation of the rotary cutter shown in FIGS. 1 and 2.

FIGS. 1, 2 and 5 show an off-line web finishing system 10 according to the present invention. A web 12 previously printed with a series of impressions 14 (FIG. 3) is unwound from a roll 16 and fed through the finishing line. The line performs multiple functions on the web, usually more than twenty, and delivers a processed product, such as a signature used to form a magazine, a specialized direct mail solicitation with a tear out return mail form, or an envelope, to a final delivery conveyor 18 at the end of the line. The impressions have a repeat length L (FIG. 3) along the longitudinal axis of the web which typically corresponds to the circumference of a print cylinder, 630 mm being a common value. Because of the elastic and environmentally sensitive nature of paper, the repeat length of the impressions 14 can and usually will vary from the expected length. FIG. 3 shows a cumulative error where the impressions are each printed long. The transverse dashed lines 20 illustrate where a finishing function, such as the operation of a rotary cutter, will fall on the web in the absence of correction. While the problem as illustrated in FIG. 3 is exaggerated, it clearly demonstrates how cumulative errors of the same type (a long or short repeat length) can rapidly lead to a cut 20*a* within an impression, not between impressions as shown at 20*b*. The web so cut, within an impression, is not usable. Besides the cumulative errors, the paper may expand or contract locally in a highly unpredictable manner resulting in localized and rapidly changing positional errors that can also be of a sufficient magnitude to result in an operation being performed on the web so as to destroy the product.

Figure 4A:
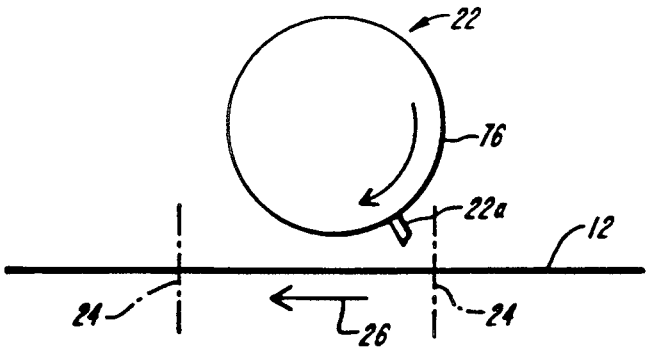
FIGS. 4A and 4B are schematic views in side elevation of a rotary cutter rotating in coordination with the moving web shown in FIGS. 1–3.
Figure 4B:
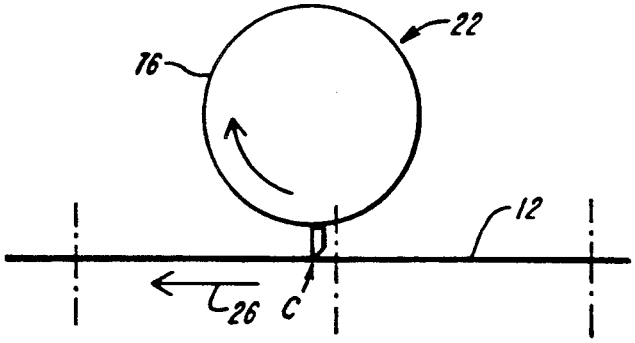

FIGS. 4A and 4B illustrate in a simplified manner the timing between the operation of a function cylinder, here a rotary cutter 22, and the web. In FIGS. 4A and 4B dashed lines 24 represent the location of registration marks on the web. The web moves in the direction of arrow 26. In FIG. 4A a blade 22*a* is rotating toward a cutting position where it impacts on the web for an instant. In FIG. 4B the blade has rotated in conjunction with an advance of the web to cut the web at point C. This illustrates a misregistration or timing error since the cut occurs ahead of the desired location here taken to be the registration mark.

The system 10 begins with a splicer 28 that feeds the rewound web from the roll 16 to an infeed device 30 having draw rolls that in turn feed the web to the rest of the line of finishing equipment. The infeed device, such as the web guide and infeed sold by MEG as model 640H, sets the tension in the web. The desired value for the web tension is selected at the infeed and it varies the web feed rate to maintain the tension at the desired value. The draw rolls of all of the equipment in the system 10 are driven in unison from a common line shaft 38. Conventional gear boxes 40 couple the line shaft to shafts that each mount one of the draw rolls 41 (not all of which are shown in FIG. 2). A motor 42, preferably a 75 HP D.C. motor or the like, provides the motive power for the line shaft 38 via a transmission belt 44. The motor 42, line shaft 38, gear boxes 40, and draw rolls 41 form a web transport system 45 that conveys the web 12 through the system 10 at a constant tension, at high speed, e.g. 1,000 to 2,000 fpm. The set, constant level of tension will depend on the characteristics of the web and the finishing operations performed. In a typical finishing line, the tension for very light weight webs such as tissue used to form airmail envelopes, will be set at a correspondingly low value, such as 0.3 pounds per linear inch (pounds-force divided by the width of the web in inches). For more conventional paper, the set value of the tension is set typically in the range of 2 to 5 lbs force/linear inch. For heavier stock, such as cardboard products, the tension level in the web is normally set at a higher value, such as 15 lbf/linear inch. In each case, the tension should be sufficient only to facilitate the handling and finishing of the web but not sufficient to stretch the web as occurs in conventional printing and finishing equipment.

It is also significant that there is no slippage between the draw rolls and the web. The draw rolls act in cooperation with air loaded trolley nips 47 (FIG. 5) or opposed rolls which secure the web to travel in unison with the draw roll. Because all of the draw rolls are driven from a common line shaft, they rotate at the same speed which avoids variations in the rate of travel of the web which can produce variations in the tension in the web. Stated in other terms, once a desired line of tension is set between the infeed 30 and the nip of the first draw roll 41 (as shown, at a chill roll 56), it is held constant throughout the finishing line. This arrangement is in strong contrast to conventional registration arrangements which use an overdriven variable speed draw roll with slippage between the roll and the web to stretch the web into registration, or allow it to shrink back into registration as less overdrive is applied. It is noteworthy that applicants' system can include equipment such as an imager 46 that sprays ink onto the web under computer control and then dries the ink, and glue patterns applied by a segmented remoistenable gluer 48, in a dryer 50. The application of wet ink and glue and then the drying, induce some changes in the characteristics of the web. While the change in tension is comparatively minor, typically less than ±5%, it is automatically and continually compensated for by the infeed 30 so that the web leaving the chill rolls 56 is at the constant preselected value, despite the presence of moistening and drying operations in the finishing line. This arrangement is believed to be unique in that heretofore finishing lines would not include a gluer and a dryer. As a result, segmented gluing wa applied at the press before the web was rewound. This leads to the problem that the rewound web has a pattern of relatively thick glue which can cause the web to be wound in an uneven manner. The present invention thus allows the printing press to limit its functions to lithography.

The web finishing system also includes a pattern perforator 52, a sequential numbering unit 54, the chill roll 56 located after the dryer 50, a silicone applicator 58, a ribbon deck 60 that slits the web into plural parallel ribbons, a compensator unit 62 that maintains registration between parallel ribbons formed in the web, a rotary die cutter 64, an envelope gluer 66, plow stations 68, 70, 72 and 74 each with at least one draw roll powered from the main line shaft, and the rotary cutter 22 which has the final draw roll in the line.

As will be understood by those skilled in the art, the line illustrated in FIGS. 1, 2 and 5 is exemplary only. A wide flexibility exists in adding or deleting equipment from the line, or in selectively deactivating one or more pieces of equipment which are not required to produce a particular product. For example, if no die cut are required, the die cutter 64 can be set "off impression" so that the web runs through the die cutter with no die cuts being made in the web. Certain of these pieces of equipment, the dryer, chill rolls, silicone applicator, ribbon deck, compensator, and the plow stations, operate on the web without regard to the location of printed matter on the web. They are registration insensitive. Other pieces of equipment, the pattern perforator, numbering unit, segmented gluer, die cutter, envelope gluer and rotary cutter are registration sensitive. Each has at least one function cylinder 76 that performs an operation on the web which must be precisely coordinated with the printed pattern of impressions on the web. As shown in FIGS. 4A, 4B and 5, on the rotary cutter the function cylinder carries the blade 22*a*; the operation of this function cylinder is a cut across the web. It should be noted that the plow stations 72 and 74 also include spot gluers 77,77 associated with function cylinders 76,76 powered through the secondary drive system 75. The spot gluers 77,77 are registration sensitive.

A secondary drive system 75 rotates all of the function cylinders 76. The main line shaft 38 drives a secondary line shaft 80 of the system 75 through a variable transmission 82. Gear boxes 84 transmit power from the shaft 80 to the function cylinders via shafts 86 and phasing gears 88. Motors 90 associated with the phasing gears 88 and acting under the control of signals over lines 92 from the controller 36 provide a phase adjustment between the angular position of the shaft 86 and the associated function cylinder 76. The control signals on the lines 92 correspond to the difference in the position of 1) the registration marks on the web, as sensed by an optical scanner 94 associated with each piece of registration sensitive equipment, and 2) the angular position of the function shaft as sensed through a conventional encoder 96. As will be discussed in more detail below, the phasing gears 88 provide a registration adjustment that "fine tunes" the registration control system, principally by correcting for localized errors. For clarity, only one scanner 94 is shown, in FIG. 5, but it will be understood that in the preferred from one such scanner is located adjacent each registration sensitive piece of equipment in the line. The scanners 94 also preferably monitor each impression, as opposed to monitoring intermittently. No finishing line known to applicants monitors each impression. Suitable scanners 94 are sold by Web Printing Controls Co., Inc. of Barrington, Ill.

The transmission 82 is a one way drive; the secondary line shaft 80 is driven by and follows the main line shaft, but the reverse does not occur. A motor 98 associated with the transmission 82 adjusts the phase of these two shafts in response to a control signal on-line 100 responsive to an optical scanner 102 located at the upstream end of the line, preferably prior to any registration sensitive piece of equipment. It scans the registration marks to detect accumulating errors such as those illustrated in FIG. 3. The controller 36 receives the output signal of the scanner 102, compares it to the output of an encoder on the web transport system draw rolls, and generates an output control signal for the motor 98 on the line 100. The signal varies the transmission, and thereby the phase relationship between the shafts 38 and 80, to compensate for the accumulating errors The rotation of the secondary shaft can run faster, or slower than, that of the main shaft to correct for impressions that are repeatedly print either long or short, respectively. The controller 36 for the motor 98, and for other adjusting devices described below, is part of a closed loop servo drive system. Those skilled in the art will recognize a wide range of servo drive systems can be used; applicant prefers the finishing line servo drive system sold by P.I.D. System Engineering Corp. of San Carlos, Calif.

It should be noted that there is no physical limitation on the correcting movement of the transmission 82 (as with a movable dancer roll that adjust paper path length) other than the speed and responsiveness of the transmission itself. The variable transmission manufactured by Fairchild under its trade designation Speedcon is sufficiently fast and has a dynamic response time that keeps up with even substantial accumulating errors. It is also significant that the shaft 80 connects through the gear boxes 84 and shafts 86 to all of the function cylinders and drives all of them in unison. As a result, corrections for accumulating errors made at the transmission 82 are transmitted to all of the registration sensitive cylinders in the same degree and at the same time. Because the web transport system carries the web through the line with no slippage with respect to the draw rolls, the in unison phase adjustment of all of the function cylinders corrects for cumulative error throughout the web.

A phase adjustment can occur at the function cylinders because the operating element of the function cylinders, whether a knife blade, a die plate, a glue applicator, a numbering head, etc., makes only intermittent, very brief contact with the web. This is in contrast to the draw rolls, trolley nips, and printing cylinders which are in constant contact with the web. The difference in the surface speeds of the element and the web is so slight and over so brief an interval of contact that it has a negligible adverse affect on the quality of the operation being performed on the web. This invention therefore cannot work in a printing press. Stated more generally, a fundamental difference of the present invention as compared to the techniques currently in use commercially is that in the present invention the functions are adjusted to the web, rather that adjusting the web to the function—typically by stretching the web into registration.

The present invention, in its preferred form, also has the ability to make rapid, dynamic phase adjustments at each registration sensitive piece of equipment. Specifically, the phasing gear boxes 88, such as the gear differential positioners sold by Andantax, can introduce a variable phase adjustment in the angular position of the associated function cylinder as compared to that of the secondary line shaft 80, and the shafts 86 eared to it. The motors 90 control the amount of phase shift introduced at the gears 88. The motors 90 act under the control of signals from the controller 36 which in turn reflect the output signal of the associated scanner 94. The scanners preferably monitor each registration mark to detect misregistrations as soon as possible and therefore to provide a fast response by the phasing gear to the misregistration. Because the secondary line shaft rotates with a phase difference that adjusts for cumulative errors, the individual phasing gears 88 deal principally with "localized" errors, that is, shrinkages or stretching in the web, in any direction and of a wide variety of magnitudes, which appear only in a portion of the web. These errors are not cumulative since they are not necessarily of the same type—a stretching or a shrinkage—and they often do not occur for a sufficient period of time to accumulate to a large net resultant error.

Known registration systems have been poorly equipped to deal with this type of error. One problem was that only one or two scanners were used and they monitored only one of every 10 to 100 impressions. This meant that a localized change would not be detected and corrected until after a considerable length of web had run out of register and may need to be scrapped. Another problem was the poor dynamic response of many standard phasing gears to the extremely rapid, and sometimes large, changes in the detected registration errors. In conventional systems, the errors would include cumulative errors, and would normally be beyond the capacity of the phasing gears to keep up with the required corrections, or the system would "hunt" in response to correction signals. With the present invention, the secondary drive and this variable transmission 82 corrects for the accumulating errors. As a result, the individual scanners 94 and the phasing gears are able to sense and rapidly adjust to compensate for localized errors without hunting.

In operation, the web finishing system 10 of the present invention transports a web at a preselected constant tension that is sufficient to handle and process the web, but which does not otherwise subject it to stress. The tension is set by a infeed unit operating in opposition to the draw rolls of the chill rolls, and then maintained by the no slip drive at subsequent draw rolls. The tension in the web is not used to stretch the web to maintain registration between the web and position sensitive operations. Registration is maintained by sensing the position of the web, preferably of each impression and at each registration sensitive piece of equipment, and adjusting the position of the function cylinders to the web. At least one scanner senses accumulating errors and the controller produces a control signal that adjust the phase of rotation of the secondary line to that of the main line shaft to compensate for the error and maintain registration. The second line drives function cylinders which contact the web only intermittently. The system includes phasing gears at each registration sensitive piece of equipment to correct for localized error. The secondary line follows the main line shaft and rotates all of the function cylinders in unison. The web transport system grips the web so there is no slippage between the web and the draw rolls of the web transport.

The web finishing system described above can provide off-line finishing of pre-printed webs at a high speed and with an unusually high degree of reliability and accuracy. This system can finish a wide range of web weights, including even very lightweight webs such as the tissue products used to form airmail envelopes. Because this finishing can be off-line, the speed of the finishing line does not limit the operation of the printing press nor is the press idled during make ready of the line. This allows a productivity for the press and a flexibility in scheduling which is significantly better than heretofore attainable. Also, the finishing line of the present invention can accept and finish rewound rolls printed on any press of the same repeat length, with no special conditions placed on the printing.

While the invention has been described with respect to its preferred embodiments, it will be understood that various modifications and alterations will occur to those skilled in the art from the foregoing detailed description and the accompanying drawings. For example, while the phase adjustments between lines and function cylinders have been described as achieved with certain variable phase transmissions and phasing gears, other mechanical or even non-mechanical variable phase couplings or direct drives may be used. A significant disadvantage of separate drive motors at each function cylinder, however, is an increase in cost and a less reliable and more complex system for making corrections in unison to compensate for accumulating errors. It is also contemplated that the system can run, albeit with less responsive and accurate registration control, without 1) the localized phase control, that is, using only the cumulative error correction of the secondary line shaft, or 2) with only the secondary phase system. In the latter instance, the controller must coordinate all of the phasing gears to adjust for all sensed misregistrations. The risk is that the errors can overwhelm the capacity of the system to adjust, or occur with such varying speed and orientation that the dynamic response of the phase adjustment cannot keep up with the errors. Also, while the localized corrections have been described as being made independently at each function cylinder, they also can be made in unison. Still further, while the system has been described in its preferred form as an off-line web finishing system, it is also possible to use it in-line with the press, which of course sacrifices the press productivity and perhaps speed advantages noted above. These and other modifications and variations which will occur to those skilled int he art are intended to fall within the scope of the appended claims.

What is claimed is:

1. A web finishing system for maintaining the registration between i) a succession of impressions previously printed on a web of paper in a regularly repeated pattern extending along the web in a first direction coincident with the direction of movement of the web from an infeed and ii) the location on the web where at least one finishing machine defining a finishing line having at least one function cylinder positioned to perform an operation on the previously printed web at a position on the web which must be accurately correlated along the first direction with respect to said repeated pattern, comprising means for setting the tension in the web at a constant value sufficient to maintain the web taut to facilitate its handling, means for transporting the web from the infeed through the finishing line while maintaining said constant tension in the web, said web transporting means (i) introducing no substantial elongation of the web in said first direction, (ii) introducing no slippage between the web and itself, (iii) operating independently of the registration, and (iv) operating independently of said tension setting means, means for driving said at least one function cylinder, means for monitoring the registration and generating a signal corresponding to any misregistration, and means for adjusting the phase of rotation of said at least one function cylinder with respect to said web in response to said signal to correct said misregistration, said adjusting means including a continuous ratio adjustment between the speed of operation of said finishing machines and the speed of operation of said web transporting means, and said at least one function cylinder making contact with and operating on the web intermittently.

2. The registration system of claim 1 wherein said web transport system includes draw rolls that engage the web without slippage and a main line shaft that transmits rotary power to each of said draw rolls in unison.

3. The registration system of claim 2 wherein said web transport system also includes a variable web infeed that sets and maintains the constant tension in the web.

4. The registration system according to claim 1, 2 or 3 wherein the finishing line comprises plural finishing machines each of which has at least one function cylinder and wherein said driving means includes a second line shaft that transmits rotary power to each of said function cylinders and wherein said adjusting means includes a variable transmission that transmits rotary power from said main line shaft to said second line shaft to produce said continuous ratio adjustment.

5. The registration system of claim 4 wherein said second drive shaft rotates all of said function cylinders in unison.

6. The registration system according to claim 4 wherein said variable transmission is one way, transmitting rotary power only from the main line shaft to the second line shaft.

7. The registration system of claim 4 wherein said adjusting means further comprising a phase adjusting means operatively coupled between said second line shaft and each of said function cylinders.

8. The registration system of claim 7 wherein said phase adjusting means at each function cylinder functions independently of other of said phase adjusting means.

9. The registration system of claims 1, 2 or 3 wherein said adjusting means includes i) means associated with at least one of said function cylinder for adjusting the phase of rotation of said function cylinder independently of other of the phase of said cylinders and ii) means associated with each of said at least one function cylinder for producing a signal indicative of the registration of the web to associated function cylinder, said signal controlling the operation of the associated one of said function cylinder phase adjusting means.

10. The registration system of claim 9 wherein said function cylinder phase adjusting means comprises a phasing gear.

11. A process for maintaining registration in a web finishing system between (i) a series of impressions printed in a regular, repeating pattern along the length of a web that is moving along its length from an infeed and (ii) the point of operation on the web of at least one function machine having operating elements mounted on rotatable function cylinders which intermittently perform the operation as the web moves therethrough, comprising the steps of:

setting a constant tension in said web at said infeed at a value sufficient to facilitate handling of the web but not large enough to produce any significant elongation of the web, transporting said web through the finishing system, said transporting maintaining said constant tension in said web, restraining the web against slippage with respect to elements in contact with the web performing said transporting, sensing the relative position of the printed impressions on the web with respect to the angular position of the function cylinders, producing an electrical control signal in response to said sensing, and adjusting the phase of the driven cylinders of said finishing machine in response to said electrical control signal to maintain said registration, said adjusting including a continuous ratio adjustment between the speed of operation of said finishing machine and the speed of operation of said web transport means, and said adjusting operating independently of said setting and said transporting.

12. The registration maintaining process of claim 11 wherein said adjusting comprises (i) adjusting in unison the phase of rotation of all of said function cylinders to correct for accumulating registration errors in said pattern and (ii) adjusting independently the phase of rotation of each function cylinder to correct for localized, non-accumulating registration errors.

13. The registration maintaining process of claim 11 wherein said constant tension maintaining comprises drawing said web at a fixed rate at the end of said system and feeding said web into said system at a variable rate.

* * * * *